US007185707B1

(12) United States Patent
Graham

(10) Patent No.: US 7,185,707 B1
(45) Date of Patent: Mar. 6, 2007

(54) HYDROSTATIC SEPARATOR APPARATUS AND METHOD

(76) Inventor: Robert R. Graham, 4013 Little Finger Rd., Lake Havasu City, AZ (US) 86406

( * ) Notice: Subject to any disclaimer, the term of this patent is extended or adjusted under 35 U.S.C. 154(b) by 0 days.

(21) Appl. No.: 11/293,588

(22) Filed: Dec. 2, 2005

(51) Int. Cl.
*E21B 43/00* (2006.01)

(52) U.S. Cl. ..... 166/371; 166/54.1; 166/105.5

(58) Field of Classification Search ..... None
See application file for complete search history.

(56) References Cited

U.S. PATENT DOCUMENTS

| | | | | |
|---|---|---|---|---|
| 690,986 | A | 1/1902 | Neely | |
| 1,373,720 | A | 4/1921 | Gish | |
| 3,568,835 | A * | 3/1971 | Hansen | 210/86 |
| 3,868,321 | A | 2/1975 | Gough | |
| 3,915,225 | A * | 10/1975 | Swink | 166/53 |
| 4,361,186 | A | 11/1982 | Kalina | |
| 4,528,094 | A | 7/1985 | Scragg | |
| 5,326,458 | A * | 7/1994 | Johnson | 210/122 |
| 5,484,023 | A * | 1/1996 | Shippee | 166/369 |
| 5,705,056 | A | 1/1998 | Scragg | |
| 5,918,622 | A | 7/1999 | Perez | |
| 6,368,498 | B1 | 4/2002 | Guilmette | |
| 6,375,835 | B1 | 4/2002 | Lee | |

* cited by examiner

*Primary Examiner*—Frank Tsay
(74) *Attorney, Agent, or Firm*—Dennis W. Beech

(57) ABSTRACT

The present invention may be used as an apparatus and method for extracting oil from a hydrocarbon material bearing formation. A well may be positioned in a formation having hydrocarbon material with a well casing extending into the formation that may have a number of apertures formed in the casing wall adjacent to multiple zones of interest in the formation. A hydrostatic separator may have a specific gravity approximately equal to an oil that may be extracted from the formation and may be positioned and anchored in the well casing above and adjacent to an upper level of said formation. An extraction pipe may be disposed interior to the well casing with a lower end positioned above and adjacent a separator top and may have an upper end attached at a well head. The well head may be in fluid communication with an oil storage unit and in communication with a pressure application apparatus.

18 Claims, 2 Drawing Sheets

HYDROSTATIC SEPARATOR APPARATUS AND METHOD

BACKGROUND OF THE INVENTION

This invention relates to apparatus and method for extracting oil from hydrocarbon material bearing formations. The new hydrostatic separator may be disposed in a well casing that may be an existing well that may be marginally producing or not producing at all as well as new wells for the extraction of oil. The hydrostatic separator may serve to separate the oil into an upper portion of a well casing and to suppress any water below the location of the hydrostatic separator.

Many existing oil wells throughout the world have been exploited in what may be considered an initial or first stage of oil and gas extraction. Wells have been drilled into oil formations and oil and gas recovered using the well head or geophysical ground pressure conditions to extract the oil. Over time during such production the oil formation becomes disrupted from its natural condition as the gas is removed and oil and water tend to become mixed rather than separated.

As oil well production declines, second and third stage oil recover methods may be implemented. For example, water may be forced into the formation to attempt to recover more oil. Blocking of underground flow channels may be attempted to recover oil from less permeable flow channels. Other methods may also be used to attempt to recover oil from economically marginal or nonperforming wells. Such recovery methods may have an extraction ratio of 1 barrel of oil for every 10 barrels of water. This environmentally contaminated ground water must then be processed at a cost.

In one area of California where experiments have been conducted there may be as many as 146,000 oil wells of which a large proportion or nonproducing or marginally producing due to past extraction activities. If these wells can be returned to economically performing wells, there may be a large oil reserve that may be exploited. This may also be true throughout the United States as well as in many other parts of the world.

SUMMARY OF THE INVENTION

The present invention is directed to apparatus and methods for extracting oil from a hydrocarbon material bearing formation. A well may be positioned in a formation having hydrocarbon material with a well casing extending into the formation that may have a number of apertures formed in the casing wall adjacent to multiple zones of interest in the formation. A hydrostatic separator may have a specific gravity approximately equal to an oil that may be extracted from the formation and may be positioned and anchored in the well casing above and adjacent to an upper level of said formation. An extraction pipe may be disposed interior to the well casing with a lower end positioned above and adjacent a separator top and may have an upper end attached at a well head. The well head may be in fluid communication with an oil storage unit and in communication with a pressure application apparatus.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
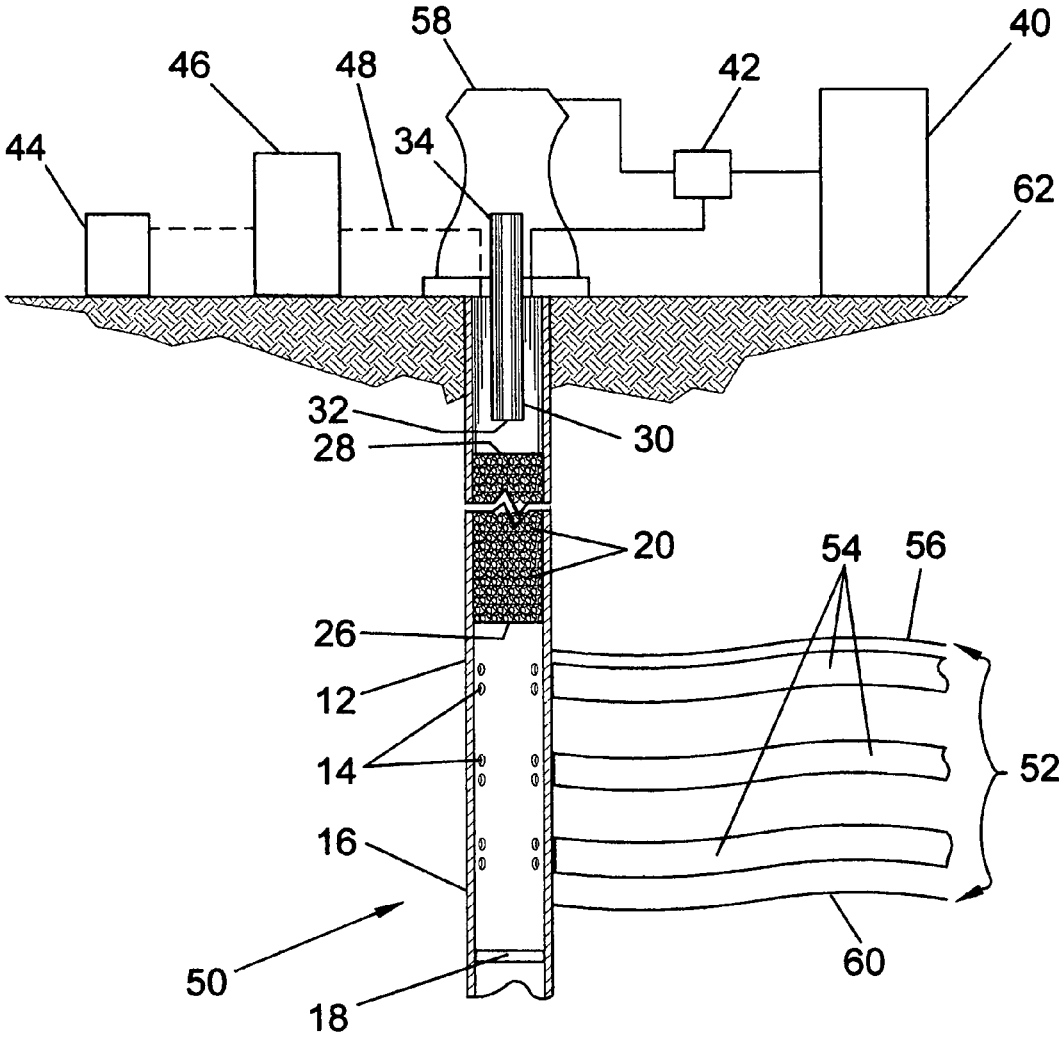
FIG. 1 illustrates a functional diagram of a hydrostatic separator oil recovery system according to an embodiment of the invention.

Referring to FIG. 1, a well 10 may be drilled from a ground surface 60 to penetrate through a hydrocarbon material bearing formation 52. The formation 52 may have multiple zones 54 that may be oil sand zones, water zones and the like. Existing wells as well as new drilled wells may be used with the hydrostatic separator 10 apparatus and method. The well casing 12 may be perforated at each of the zones 54 of interest in the formation 52 to allow fluid to enter the well casing 12 through the apertures 14 formed in the casing wall 16. A plug 18 or packing may be attached interior to the well casing 12 positioned below and adjacent to the lower level 60 of the formation 52.

The zones 54 of interest may be oil sand zones, water zones and other fluid producing zones in the formation 52 depending on the specific gravity of the fluids, the ground and hydraulic pressure structure in the formation 52, and surrounding geology. The goal may be to stabilize the well head pressure to allow economical extraction of oil from the formation 52 even under conditions where a well 50 may be marginally economical or uneconomical using existing oil extraction methods due to previous drilling and oil extraction operations.

Figure 2:
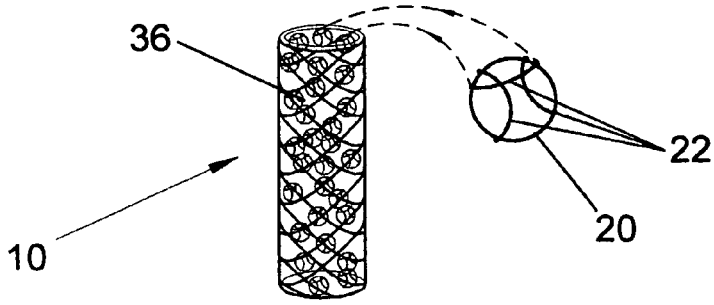
FIG. 2 illustrates a side view of a hydrostatic separator and separator element according to an embodiment of the invention.
Figure 3:
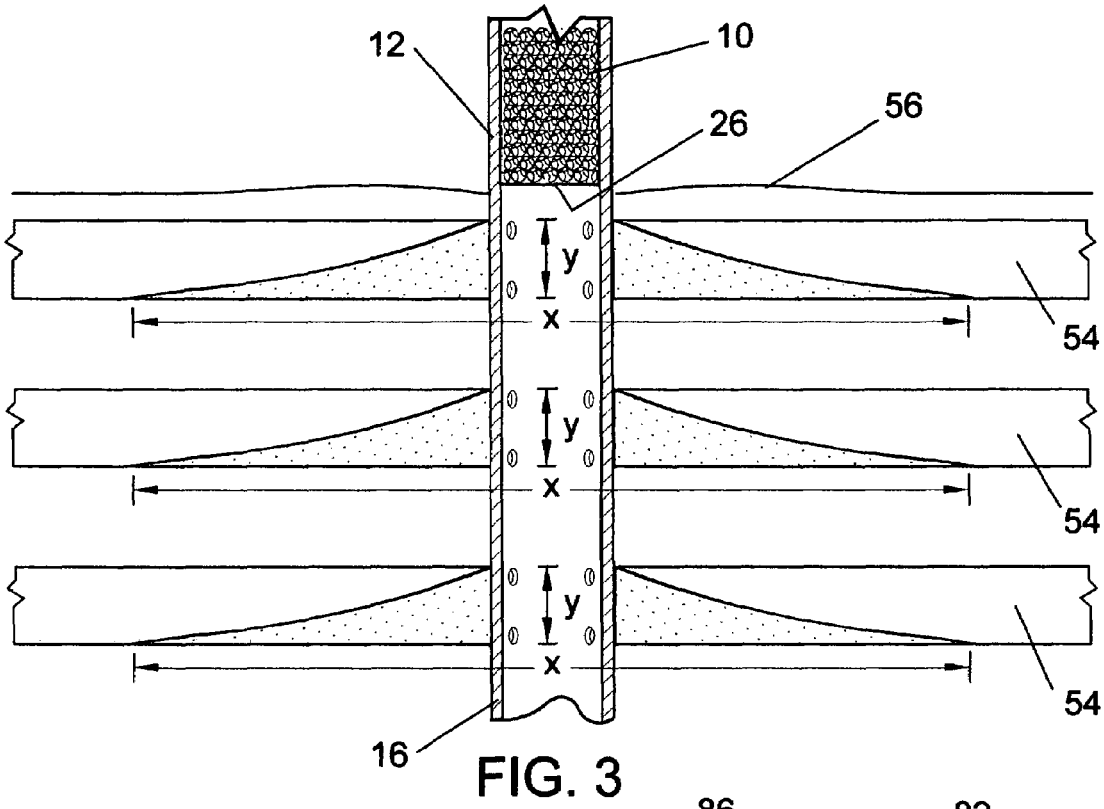
FIG. 3 illustrates a schematic representation of water barrier coning in an oil well according to an embodiment of the invention.

Referring to FIGS. 1 through 3, a hydrostatic separator 10 may be inserted in the well casing 12 and positioned at a depth that may be adjacent to and above the upper level 56 of the formation 52. The hydrostatic separator 10 may have a quantity of separator elements 20 that may extend from the upper level 56 of the formation 52 to approximately ground level or the well casing 12 top, for example, approximately 100 feet below the well casing 12 top. The separator elements 20 may be spherical in structure and have external protrusions 22 or ribs to distance adjacent separator elements one from another and for heat dissipation. Other shapes or forms of separator elements 20 may be used, such as, rectangular, octagonal and other structures, so long as spacing or separation is maintained to allow oil to pass through the hydrostatic separator 10 and to inhibit the passage of water or other undesired elements in the instance of use of the apparatus and method for oil extraction. The hydrostatic separator 10 may have one or more cylindrical container elements 36 depending on the distance in a particular well casing 12 that require separator elements 20 to be disposed therein.

The separator elements 20 may have a specific gravity that may be approximately equal to or greater than that of an oil to be extracted. The specific gravity of the separator elements 20 may be less than that of water or other fluids to be separated from the oil. The diameter of the separation elements 20 may be determined based on the density and volume of the separator elements 20 as well as the diameter of the well casing 12, for example, in a 5 inch diameter well casing 12, the diameter of separator elements 20 constructed of a plastic or PVC material may be a fraction of an inch to provide a sufficient quantity of separator elements 20 to be positioned in the well casing 12. This may allow sufficient separator element 20 spacing with protrusions 22 to allow oil, but not water to pass efficiently through the hydrostatic separator 10. The separator elements 20 may displace more than 50 percent of the volume of fluid in which they may be disposed, for example, in a well casing 12 the separator elements 20 may displace fluid such as oil by more than 50 percent of the volume of the well casing 12.

In use, the hydrostatic separator 10 may be maintained in position in the well casing 12 initially for a period of time for the casing pressure and formation 52 pressure to be stabilized as may be expected for the particular geology of the area of the formation and depth of the well. For example, in a particular formation in the state of California, the existing pressure of a producing well may only be 18 pounds per gallon due to previous oil extraction activities. With the hydrostatic separator 10 positioned in the well casing 12, the separation of the oil above the water may over a period of time, for example, four months for a particular formation, cause the well head 58 pressure to be approximately 10 times that of the initial pressure or 180 pounds per gallon.

An example well 50 structure may be a 4000 feet long casing 12 with the ground level 62 at sea level and a formation 52 having 10 zones with 20 feet average length per zone for a formation 52 length of 200 feet. Ground pressure may be 10 pounds per square inch and may create a fluid level in the well casing 12 of 2000 feet from a depth of 4000 feet. The 10 pounds per square inch may be created by gas pressure. Separator elements 20 may be disposed in the well casing 12 to fill a volume of 2000 feet of well casing 12 length. Forcing the separator elements 20 into the fluid in the bottom 2000 feet of well casing 12 may cause a portion of oil to pass through the separator elements 20 for oil to be positioned at approximately the top of the well casing 12. Pressure may be controlled in the well casing 12 by for example pumping oil into the well casing 12 to allow oil to be extracted from the well. The separator elements 20 may also be forced further downwardly in the well casing 12, and thereby into the fluid, to raise the oil level above the top of the well casing 12.

An existing oil well 50 that may be producing only a small quantity or no oil may have water barriers 100 formed adjacent to the well wall 16 at the apertures 14. These water barriers 100 may inhibit the flow of oil therein. The water barriers 100 or cones may be proportioned in the zone 54 with for example a horizontal base of "X" 115 feet and a vertical height "Y" adjacent the casing wall of 1 foot. In the process of stabilizing the casing weight or well pressure, oil may be forced into the well casing 12 through the hydrostatic separator 10 to lower the water barriers 100 and the water level in the formation 52 relative to the oil level.

In this stabilization process the formation may be adjusted to approximate the original geologic structure of the oil positioned above the water. The hydrostatic separator 10 may maintain the water barrier and the casing pressure may cause oil to flow from the formation 52 even though there may also be water in the well casing 12 below the hydrostatic separator 10. The relative densities of the oil and water in a stabilized well casing pressure may cause flow of oil to and through the hydrostatic separator 10 at a sufficient rate to create a productive oil well. Depending on a particular well structure and the formation 52, the separator elements 20 may also be positioned in the well casing 12 within the levels of the formation 52.

The oil used for stabilization may be extracted from the well 50 that is being stabilized. An extraction pipe 30 may be positioned interior to the well casing 12 with a lower end 32 positioned adjacent the separator top 28. Oil that is available in the well 50 may be extracted and a portion of the oil may be returned to the well casing 12 to further stabilize the well 50. As is explained subsequent herein this same process may be used to remove oil from a well during production.

Once a given formation 52 may have been stabilized for the particular ground geology and hydraulic or water pressure forces, an extraction pipe 30 positioned interior to the well casing 12 may be used to remove oil from the well 50. While the natural forces may cause the oil to separate from the water and thereby raise the oil level to the approximate ground level 62, the oil must be moved to an oil container 40 for storage or transport. A positive pressure force may be applied to the oil in the well casing 12 to cause the oil to flow through extraction pipe 30.

The extraction pipe 30 may be disposed in the well casing 12 interior with a lower end 32 positioned approximately adjacent the separator top 28 of the hydrostatic separator 10 and with an upper end 34 attached to a well head 58. Pressure may then be applied to the oil in the well casing 12 by hydraulic methods, air pressure or other pressure force. One method may use a diverter 42 that channels a first portion of the oil to the oil container 40 and a second portion to return to the well casing 12. The portions of oil may depend on the rate at which oil may be extracted without removing the oil so rapidly that applied pressure can not cause oil flow from the well, and the amount of pressure necessary to move the oil to the oil container 40 in sufficient quantity to be economically viable. A pressure pump such as an oil well pump jack may be used to create pressure for the oil diverter 42. If the formation 52 has not been stabilized, oil may be returned to the well casing 12 at 2 to 3 times the rate of oil transfer to the oil container 40 to aid in formation stabilization. Once the formation 52 is stabilized the storage rate to return rate may be a 1 to 1 ratio.

Figure 4:
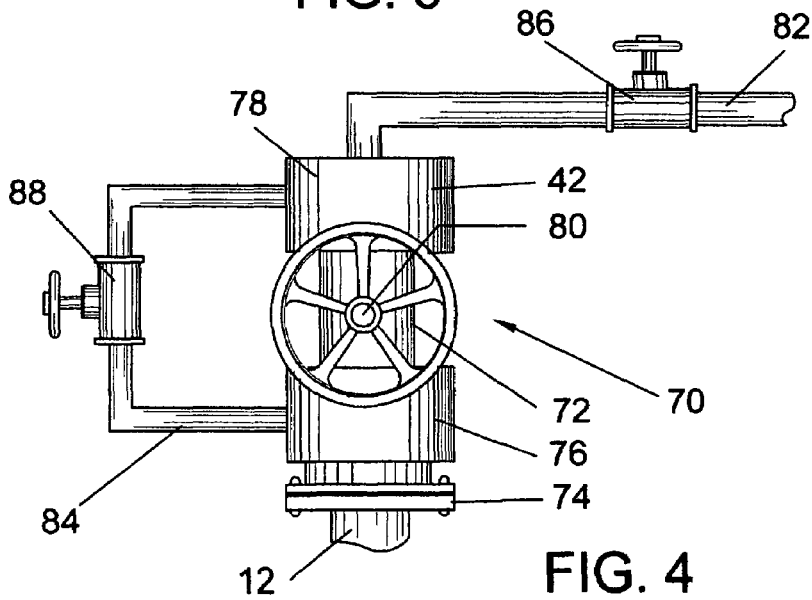
FIG. 4 illustrates an elevation view of a well head apparatus according to an embodiment of the invention.

Referring to FIGS. 1 and 4, a well head apparatus 70 may have a body 72 attached to a casing head 74. There may be a lower body portion 76 having fluid communication with the well casing 12 and an upper body portion 78. There may be a well control valve 80 for controlling access to the well as for example when separator elements 20 may be disposed in the well casing 12. The upper body portion 78 may have a diverter 42 to channel oil extracted from the well for a first portion 82 of the oil to flow to an oil container and a second portion 84 of the oil to flow to the well casing 12. There may be pressure regulators, sensors and control valves 86, 88 for monitoring and control of the oil output and the oil injected or returned to the well casing 12.

The flow of oil may also be controlled in a timed manner wherein oil may be extracted from the well for a period of time, for example, 6 minutes in an hourly period, and there may be no extraction of oil for 54 minutes of the time period. This manner of operation may allow the oil in the hydrostatic separator 10 to replenish. If casing pressure may reduce to a nonacceptable level, oil may then be pumped into the well casing 12.

An alternate method for application of pressure in the well casing 12 may be the use of compressed air or gas at the well head. An air compressor 44 may be in fluid communication with a balancing chamber 46 in which a portion of the chamber 46 has oil received from the well casing 12 and the remainder of the balancing chamber 46 may have gas under pressure to maintain pressure in the well casing 12.

While the invention has been particularly shown and described with respect to the illustrated embodiments thereof, it will be understood by those skilled in the art that the foregoing and other changes in form and details may be made therein without departing from the spirit and scope of the invention.

I claim:

1. A method for extracting oil from a hydrocarbon material bearing formation comprising:

perforating a well casing extending from the ground level to a formation in at least one zone of interest in said formation to form a plurality of apertures in a casing wall of said well casing;

disposing a plurality of separator elements having a specific gravity approximately equal to an oil to be extracted from said formation in said well casing above and adjacent an upper level of said formation with said plurality of separation elements maintained in said well casing;

disposing an extraction pipe interior to said well casing with a lower end positioned above and adjacent a separator top and with an upper end attached to a well head;

applying pressure to said well casing for a period of time for a casing pressure to stabilize at a pressure for extraction of oil through said extraction pipe.

2. The method as in claim 1 wherein, after allowing said period of time, applying pressure to a fluid in said well casing to cause the oil in said extraction pipe to flow through a conduit to an oil container.

3. The method as in claim 2 wherein said extraction pipe is in fluid communication with a diverter that channels a first portion of said oil to said oil container and a second portion of said oil to said well casing under pressure.

4. The method as in claim 2 wherein flowing of oil through said conduit is controlled by a time method wherein in a set time period oil is allowed to flow for a portion of said set time period.

5. The method as in claim 4 wherein oil is channeled to said well casing under pressure if a well casing pressure reduces to a predetermined pressure level.

6. The method as in claim 2 wherein pressure is applied by an air pressure apparatus in communication with the interior of said well casing.

7. The method as in claim 6 wherein said air pressure apparatus is an air compressor connected to a balancing chamber that is connected to said well head and said air pressure is regulated to maintain a force on a well head pipe to inhibit air from entering the well casing and to inhibit oil from entering said balancing chamber.

8. The method as in claim 1 wherein said separator elements displace more than 50 percent of the volume of a well casing portion in which said separator elements are disposed.

9. The method as in claim 1 wherein said separator elements are retained in a hydrostatic separator and said separator elements are spherical in form with a plurality of ribs formed on an outer surface.

10. An apparatus for extracting oil from a hydrocarbon material bearing formation comprising:

a well positioned in a formation having hydrocarbon material with a well casing extending into said formation that has a plurality of apertures disposed in a casing wall adjacent a plurality of zones of interest in said formation;

a hydrostatic separator having a specific gravity approximately equal to an oil to be extracted from said formation is disposed and anchored in said well casing above and adjacent an upper level of said formation;

an extraction pipe disposed interior to said well casing having a lower end positioned above and adjacent a separator top and having an upper end attached at a well head;

said well head in fluid communication with an oil storage unit and in communication with a pressure application apparatus.

11. The apparatus as in claim 10 wherein said hydrostatic separator comprising a plurality of separator elements sized to be disposed in said well casing and having a shape to allow oil to pass through said separator elements.

12. The apparatus as in claim 11 wherein said plurality of separator elements displace more than 50 percent of the volume of a well casing portion in which said plurality of separator elements are disposed.

13. The apparatus as in claim 11 wherein said separator elements are spherical in form with a plurality of ribs formed on an outer surface.

14. The apparatus as in claim 10 wherein said hydrostatic separator at a separator bottom is disposed in said well casing within said formation.

15. A hydrostatic separator comprising:

a plurality of separator elements having an irregular shape to allow passing of a liquid between adjacent separator elements;

said separators elements having a specific gravity approximately equal to a first liquid to be extracted from a second liquid wherein said second liquid having a lower specific gravity than said first liquid; and said separator elements sized to be disposed in a conduit containing said first liquid and said second liquid.

16. The hydrostatic separator as in claim 15 wherein said separator elements are retained in a container sized to be inserted into said conduit.

17. The hydrostatic separator as in claim 15 wherein said separator elements are spherical in form with a plurality of ribs formed on an outer surface to form an irregular shape.

18. The hydrostatic separator as in claim 15 wherein said separator elements sized to displace more than 50 percent of the volume of a conduit portion in which said separator element are disposed.

* * * * *